US005903285A

United States Patent [19]

Ju et al.

[11] Patent Number: 5,903,285

[45] Date of Patent: May 11, 1999

[54] CIRCUIT AND METHOD FOR DETECTING INK CARTRIDGE MOUNTING IN INK JET RECORDING APPARATUS

[75] Inventors: Young-Bok Ju, Seongnam; Jae-Han Lee, Kyungki-do, both of Rep. of Korea

[73] Assignee: SamSung Electronics Co., Ltd., Suwon, Rep. of Korea

[21] Appl. No.: 08/666,819

[22] Filed: Jun. 19, 1996

[30] Foreign Application Priority Data

Oct. 17, 1995 [KR] Rep. of Korea ..... 95-35823

[51] Int. Cl.[6] ..... B44J 29/38

[52] U.S. Cl. ..... 347/5; 347/14; 347/19

[58] Field of Search ..... 400/74, 175; 347/19, 347/5, 6, 7, 9, 14

[56] References Cited

U.S. PATENT DOCUMENTS

| | | | |
|---|---|---|---|
| 4,530,611 | 7/1985 | Borcenk et al. . | |
| 5,049,904 | 9/1991 | Nakamura et al. | 346/76 PH |
| 5,121,502 | 6/1992 | Bowling . | |
| 5,138,342 | 8/1992 | Kurata et al. . | |
| 5,138,344 | 8/1992 | Ujita . | |
| 5,162,818 | 11/1992 | Karita et al. . | |
| 5,500,664 | 3/1996 | Suzuki et al. . | |
| 5,528,269 | 6/1996 | Drogo et al. | 347/19 |

*Primary Examiner*—John Hilten
*Attorney, Agent, or Firm*—Robert E. Bushnell, Esq.

[57] ABSTRACT

An ink cartridge detection circuit and method for detecting whether an ink cartridge is mounted in an ink jet recording apparatus. The ink cartridge circuit includes a driver for driving a corresponding nozzle by applying a driving power supply voltage to a corresponding heating element; a voltage detector connected to the heating elements for detecting a voltage level of the driving power supply voltage dropped by means of driving of the heating elements; and a controller for driving one or more of the heating elements through the driver and for comparing a voltage level detected by the voltage detector with a preset reference voltage level in order to detect whether an ink cartridge is mounted on a carriage of the ink jet recording apparatus.

22 Claims, 2 Drawing Sheets

CIRCUIT AND METHOD FOR DETECTING INK CARTRIDGE MOUNTING IN INK JET RECORDING APPARATUS

CROSS-REFERENCE TO RELATED APPLICATION

This application makes reference to, incorporates the same herein, and claims all benefits accruing under 35 U.S.C. §119 from an application for Circuit And Method For Detecting Ink Cartridge Mounting In Ink Jet Recording Apparatus earlier filed in the Korean Industrial Property Office on Oct. 17, 1995, and there duly assigned Serial No. 35823/1995.

BACKGROUND OF THE INVENTION

1. Technical Field

The present invention relates to an ink jet recording apparatus for recording images on a recording medium by discharging ink from an ink cartridge to the recording medium through a nozzle, and more particularly, to a circuit and method for detecting whether an ink cartridge is mounted in an ink jet recording apparatus and the type of ink cartridge mounted in the ink jet recording apparatus.

2. Background Art

Substantial developments have been made in the field of electronic recording technology. Specifically, a wide variety of highly efficient recording systems currently available which are capable of recording characters and images onto a recording medium such as, for example, paper and overhead projection film in a rapid and accurate manner. Thermal ink jet recording systems are particularly popular in this regard primarily because they exhibit various advantages such as, for example high printing speed, low noise, easy color printing, simply construction and low price. The concepts and operational principles of thermal ink jet recording systems are well described, for example, in U.S. Pat. No. 5,138,342 for Ink Jet Cartridge And Ink Jet Recording Apparatus Employing The Same issued to Kurata et al., and U.S. Pat. No. 5,500,664 for Ink Jet Recording Apparatus And Detachably Mountable Ink Jet Cartridge issued to Suzuki et al., all of which are incorporated herein by reference.

In general, an ink jet cartridge is detachably mounted on a recording head carriage assembly which supports a recording head, and traverses the recording head across the width of a recording medium in line recording operation. An ink jet cartridge is typically constructed in an unitary, detachable cartridge which contains an ink container for containing the ink, drop generating structures and electrically connections adapted for electrically coupling a recording head to the ink jet recording apparatus which provides drop generating energy in response to information signals generated by the ink jet recording apparatus. The principle behind this type of ink jet recording apparatus is the generation of the thermal pressure wave the ink container and subsequent emission of ink droplets from the ink container through a plurality of nozzles arranged vertically at a front end of a recording head. The thermal pressure wave is generated by selected heating elements installed in the nozzles, which heat the ink contained within the nozzles until the ink is ejected through an ejection orifice of the nozzles to produce a flying droplet of the ink. The droplet is deposited on the recording medium so that a desired character and image can be formed.

When the ink in the ink container is used up, however, the entire ink jet cartridge including a recording head needs to be replaced. This is required because the ink jet cartridge is typically constructed in a unitary structure regardless of whether such an ink jet cartridge involves a relatively large difference between the period in which the ink in the ink container is used up and the service life of the recording head. Although there has been proposed construction of an ink jet cartridge in which the ink container is detachably mounted to a recording head so as to permit replacement of the ink container and the recording head separately at different times, the ink jet cartridge still needs to be taken out from the ink jet recording apparatus for replacement of an entire ink jet cartridge or an individual part of the ink jet cartridge. Accordingly, it is necessary for the ink jet recording apparatus to be able to efficiently detect whether a new or replaceable ink cartridge is mounted on a recording head carriage for recording characters and images on a recording medium. However, not all ink jet recording systems are capable of efficaciously detecting a replaceable ink cartridge mounted thereon. More often, users tend to throw out the old ink cartridge but forget to mount a new ink cartridge for replacement. In such a situation, the recording operation is performed without the ink container mounted thereon. This, however, is not a desirable situation because air may be introduced into the ink passageway and contribute to the ink ejection failure.

Unfortunately, conventional ink jet recording apparatus requires additional detection pins mounted in the ink cartridge to detect the presence or absence of an ink container or a recording head. For example, U.S. Pat. No. 5,212,502 for Ink Jet Print Head Mounting Mechanism issued to Bowling requires both an ink jet cartridge and a carriage to contain a complementary panel of electrical contacts to determine whether the ink jet cartridge is mounted on the carriage. In Suzuki et al., U.S. Pat. No. 5,500,664 for example, a pair of detection pins are mounted on side surfaces of an ink cartridge holder to detect the presence or absence of an ink container. If additional detection pins are mounted in the ink cartridge, as I have observed however, a railroad is also required to connect the ink cartridge to the detection pins which undesirably increase the number of electrical pins in a connector. Further, even if additional detection pins are required to detect the mounting of a replaceable ink jet cartridge mounted on a carriage, it has also been my observation that the conventional ink jet recording apparatus is still unable to distinguish the type of an ink jet cartridge mounted therein. In other words, the conventional ink jet recording apparatus is only capable of detecting whether an ink cartridge is mounted on a carriage, and is not capable of detecting whether a mounted ink jet cartridge is one is a mono ink cartridge an a color ink cartridge.

SUMMARY OF THE INVENTION

Accordingly, it is therefore an object of the present invention to provide an ink cartridge detecting circuit in an ink jet recording apparatus and a method capable of detecting whether an ink cartridge is mounted therein the ink jet recording apparatus without using additional detection pins in the ink cartridge.

It is another object of the invention to provide an ink cartridge detecting circuit in an ink jet recording apparatus and a method capable of detecting the type of an ink cartridge mounted in the ink jet recording apparatus.

These and other objects of the present invention can be achieved by an ink jet recording apparatus constructed to include a driver for driving a corresponding nozzle by applying a driving power supply voltage to a respective heating element. A voltage detector is connected to the heating elements and a voltage terminal, for detecting a voltage level dropped in the driving power supply voltage by means of driving of the heating elements. A controller is operatively connected to the voltage detector and the driver, for driving one or more of the heating elements through the driver and for comparing a voltage level to be detected by the voltage detector with a preset reference voltage level in order to detect whether an ink cartridge is mounted on a carriage of the ink jet recording apparatus. When the detection voltage level is higher than a first reference voltage level, the ink jet recording apparatus determines the ink cartridge has been mounted therein. When the detection voltage level is lower than the first reference voltage level, however, the ink jet recording apparatus determines that the ink cartridge has not been mounted therein.

In addition, if the detection voltage level is higher than the first reference voltage level and is also higher than a second reference voltage level, the ink jet recording apparatus determines that a mounted ink cartridge is a color ink cartridge. If, on the other hand, the detection voltage level is lower than the second reference voltage level, the ink jet recording apparatus determines that a mounted ink cartridge is a mono ink cartridge.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
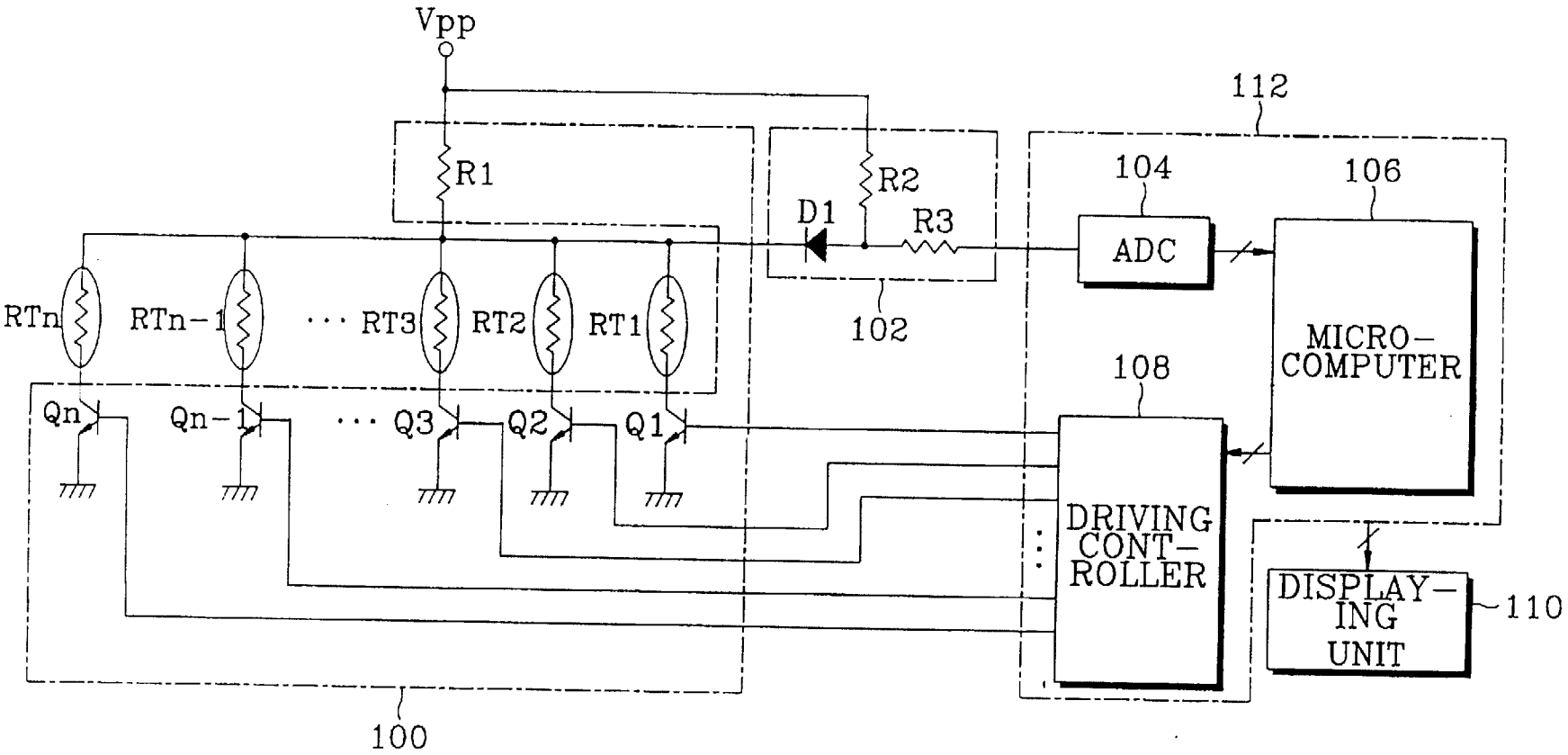
FIG. 1 illustrates an ink jet recording apparatus constructed to detect the mounting of an ink cartridge according to the principles of the present invention.

Referring now to the drawings and particularly to FIG. 1, which illustrates a block construction of an ink jet recording apparatus using a detachable ink cartridge (not shown) having an array of nozzles formed on the top of a recording head capable of detecting the mounting of an ink cartridge according to the present invention. The ink jet recording apparatus includes a driver 100 for driving corresponding nozzles of the recording head by applying a driving power supply voltage Vpp to corresponding heating elements RT1 to $RT_N$. A voltage detector 102 is connected to the heating elements RT1 to $RT_N$ and a voltage terminal Vpp, for detecting a voltage level dropped in the driving power supply voltage by the driving of the heating elements RT1 to $RT_N$. A controller 112 is operatively connected to the voltage detector 102 and the driver 100 for driving one or more of the heating elements RT1 to $RT_N$ through the driver 100, and for comparing a voltage level to be detected by the voltage detector 102 with a preset reference voltage level in order to detect whether an ink cartridge is mounted on a carriage of the ink jet recording apparatus.

A plurality of heating elements RT1 to $RT_N$ are mounted to have a one-to-one correspondence to the nozzles of a recording head of an ink cartridge. The heating elements are constructed to heat and discharge the ink within a corresponding nozzle when driven by a driving power supply voltage Vpp. The ink jet cartridge described is a typically unitary construct and detachable cartridge including an ink container for containing the ink, and a recording head. The driver 100 is comprised of a first resistance element R1 connected between the driving power supply voltage Vpp and each corresponding terminal of the heating elements RT1 to $RT_N$. Transistors Q1 to $Q_N$ are operatively connected to respective heating elements and a ground terminal and serve as switching elements for enabling the controller 112 to control operation of the heating elements RT1 to $RT_N$ in order to heat and force ejection of ink through an ejection orifice of the nozzles to produce a flying droplet of the ink The droplet of ink is deposited on a recording medium so that a desired character and image can be formed.

The driver 100 applies the driving power supply voltage Vpp to the corresponding one of the heating elements RT1 to $RT_N$ by means of signals applied to base terminals of the transistors Q1 to $Q_N$ from a driving controller 108, and then drives the corresponding nozzle of a recording head. A voltage detector 102 comprises a second resistance element R2, a diode D1 which are connected in series between the driving power supply voltage Vpp and a corresponding terminal of the heating elements RT1 to $RT_N$, and a third resistance element R3 coupled to a coupling node between the second resistance element R2 and the diode D1. The voltage detector 102 detects a voltage level of the driving power supply voltage Vpp dropped by driving of the heating elements RT1 to $RT_N$.

The controller 112 includes an analog-to-digital converter (hereinafter, called "ADC") 104, a driving controller 108, and a microcomputer 106 operatively connected to both the ADC 104 and the driving controller 108 for controlling the ink cartridge detection as contemplated by the present invention. The driving controller 108 drives the transistors Q1 to $Q_N$ according to data applied from the microcomputer 106. The ADC 104 converts the voltage level input by connecting an input terminal thereof to the coupling node of the second resistance element R2 and the diode D1 through the third resistance element R3, into a digital data having a value corresponding to the voltage level, and then applies the digital data to the microcomputer 106. The microcomputer 106 drives the heating elements RT1 to $RT_N$ by simultaneously turning on all the transistors Q1 to $Q_N$ through the driving controller 108 and compares a value of data output from the ADC 104 with a preset reference voltage level in order to detect whether the ink cartridge is mounted on a carriage of the ink jet recording apparatus.

Figure 2:
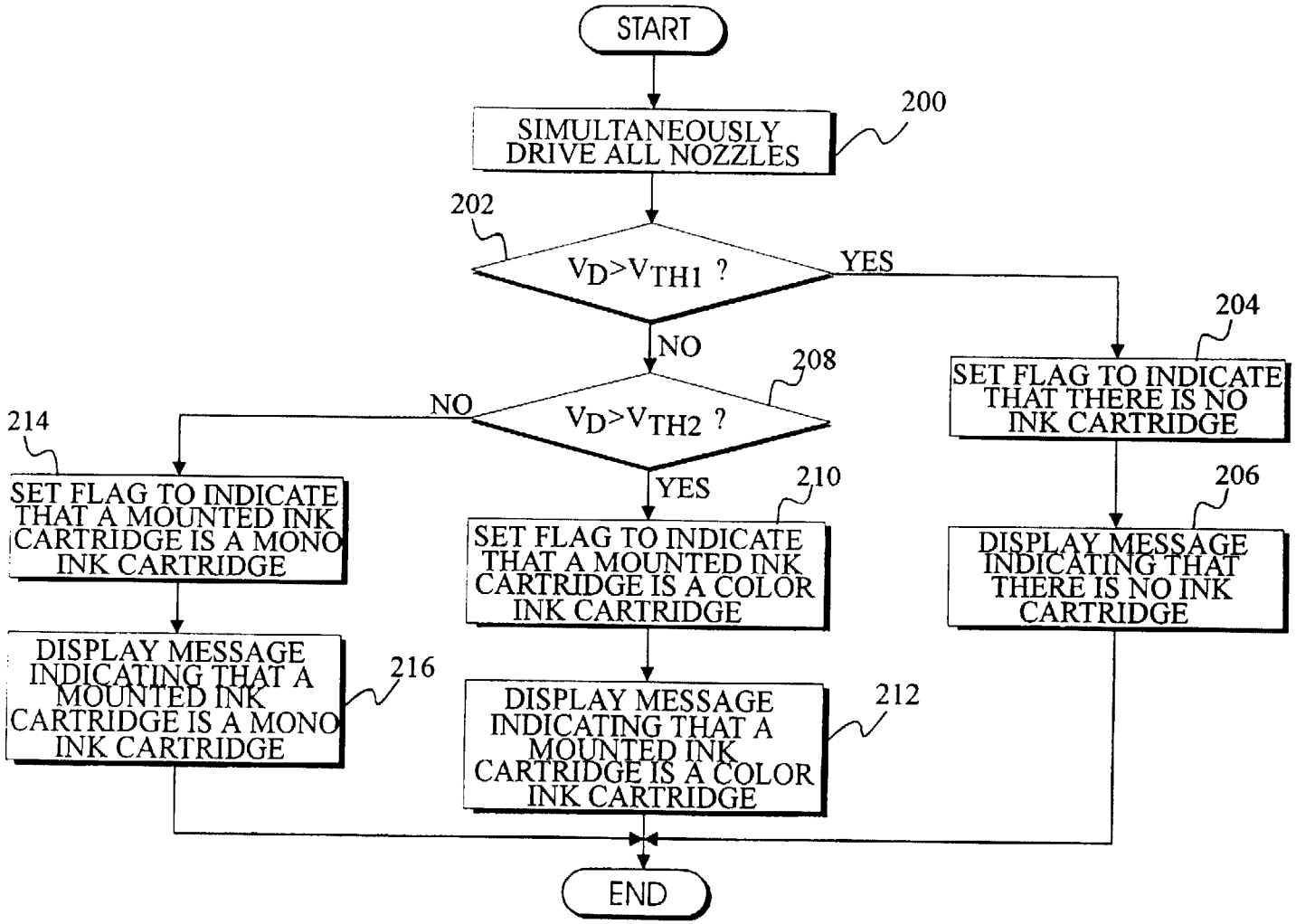
FIG. 2 is a flow chart illustrating an ink cartridge detection implemented by the ink jet recording apparatus according to the present invention.

Turning now to FIG. 2 which is a flow chart illustrating an ink cartridge detection implemented by the ink jet recording apparatus constructed according to a preferred embodiment of the present invention. The preferred embodiment of the present invention will be explained in detail as follows.

First, if at least one or more of the transistors Q1 to $Q_N$ is turned on, a current path is formed where current by the driving power supply voltage Vpp flows to ground from the second resistance element R2 and the diode D2 through the corresponding heating element and transistor. The voltage level at the coupling node between the second resistance element R2 and the diode D1 is lower than when the transistors Q1 to $Q_N$ are all at the "off" state. The voltage level is low in proportion to the number of heating elements RT1 to $RT_N$ and transistors which are at the "on" state and connected thereto. This is because the heating elements having the same resistance value are parallel coupled to each other, so that the greater the number of heating elements RT1 to $RT_N$ are operating, the smaller the synthetic resistance value becomes. Further, the voltage level at the coupling node between the second resistance element R2 and the diode D1 is converted into the digital data having a value corresponding thereto by means of the ADC 104, and then applied to the microcomputer 106.

Accordingly, when all the transistors Q1 to $Q_N$ are turned on simultaneously, the microcomputer 106 determines whether or not the ink cartridge has been mounted on a carriage of the ink jet recording apparatus by detection the change of the data value input from the ADC 104. As previously noted, the present invention is intended to establish as a first reference voltage level $V_{Th1}$ the voltage level between the voltage level applied to the ADC 104 through the third resistance element R3 when all the transistors Q1 to $Q_N$ are turned off, and another voltage level applied to the ADC 104 through the third resistance element R3 when only one of the transistors Q1 to $Q_N$ is turned on. Accordingly, when a detection voltage level $V_D$ corresponding to the data value applied from the ADC 104 is higher than the first reference voltage level $V_{TH1}$ in the situation when all the transistors Q1 to $Q_N$ are turned on simultaneously, the microcomputer 106 determines that an ink cartridge has not been mounted on a carriage of the ink jet recording apparatus. This is because the heating elements RT1 to $RT_N$ are not operating to apply heat to the ink contained in the ink container even though all of the transistors Q1 to $Q_N$ are turned on simultaneously. Consequently, the detection voltage level $V_D$ is higher than the first reference voltage level $V_{TH1}$. If, on the other hand, the detection voltage level $V_D$ is lower than the first reference voltage level $V_{TH1}$ in the situation when all the transistors Q1 to $Q_N$ are turned on simultaneously, the microcomputer 106 determines that the ink cartridge has been mounted on a carriage of the ink jet recording apparatus. This is because the heating elements RT1 to $RT_N$ are connected in parallel in order to generate heat and force ejection of ink through an ejection orifice of the nozzles for forming desirable characters and images on a recording medium, when all of the transistors Q1 to $Q_N$ are turned on. Consequently, the detection voltage level $V_D$ is lower than the first reference voltage level $V_{TH1}$.

After the ink cartridge has been mounted on a carriage of the ink jet recording apparatus, it is also possible to detect whether a mounted ink cartridge is one of a mono ink cartridge and a color ink cartridge. Generally, the mono ink cartridge has a greater number of nozzles than that of the mono ink cartridge. For example, the mono ink cartridge widely used in the ink jet recording apparatus has fifty to sixty-four nozzles, whereas the color ink cartridge has forty-eight nozzles. Therefore, if the microcomputer 106 simultaneously turns on all the transistors Q1 to $Q_N$, the detection voltage level $V_D$ is higher when the color ink cartridge has been mounted than when the mono ink cartridge has been mounted. For this reason, the present invention seeks to establish as a second reference voltage level $V_{TH2}$ the voltage level between the detection voltage level $V_D$ detected when the microcomputer 106 simultaneously turns on all the transistors Q1 to $Q_N$ for the situation that the mono ink cartridge has been mounted, and another detection voltage level $V_D$ detected when the microcomputer 106 simultaneously turns on all the transistors Q1 to $Q_N$ for the situation that the color ink cartridge has been mounted. For instance, when all the transistors Q1 to $Q_N$ are turned on simultaneously by the microcomputer 106, and if the detection voltage level $V_D$ is lower than the first reference voltage level $V_{TH1}$ and but is higher than the second reference voltage level $V_{TH2}$, the microcomputer 106 determines that the color ink cartridge has been mounted on a carriage of the ink jet recording apparatus. On the other hand, when all the transistors Q1 to $Q_N$ are turned on simultaneously by the microcomputer 106, and if the detection voltage level $V_D$ is lower than the first reference voltage level $V_{TH1}$ and is also lower than the second reference voltage level $V_{TH2}$, the microcomputer 106 determines that the mono ink cartridge has been mounted on a carriage of the ink jet recording apparatus.

The above operation will be explained hereinafter with respect to FIG. 2. The microcomputer 106 simultaneously turns on all of the transistors Q1 to $Q_N$ through the driving controller 108 in order to drive all nozzles of a recording head at step 200 when the ink jet recording apparatus including an ink cartridge detecting circuit of FIG. 1 is initialized. Thus, the heating elements RT1 to $RT_N$ are driven at once by application of the driving power supply voltage Vpp thereto through the first resistance element R1. At this time, if the ink cartridge has been mounted on a carriage of the ink jet recording apparatus, the ink within the nozzles is discharged. Further, in order to prevent pollution caused due to the discharged ink, it is desirable that such operation is performed when the ink cartridge is at a capping location.

Is Next, the microcomputer 106 compares, at step 202, the detection voltage level $V_D$ according to the data value applied from the ADC 104 with the first reference voltage level $V_{TH1}$. When the detection voltage level $V_D$ is higher than the first reference voltage level $V_{TH1}$, the microcomputer 106 recognizes that the ink cartridge has not been mounted and sets a flag to indicate that there is no ink cartridge mounted on a carriage at step 204. The displaying unit 110 then displays a message indicating that there is no ink cartridge. By contrast, when the detection voltage level $V_D$ is lower than the first reference voltage level $V_{TH1}$, the microcomputer 106 determines that the ink cartridge has been mounted on a carriage, and then compares, at step 208 the detection voltage level $V_D$ with the second reference voltage level $V_{TH2}$ so as to detect the type of ink cartridge mounted on a carriage. At this point, if the detection voltage level $V_D$ is higher than the second reference voltage level $V_{TH2}$, the microcomputer 106 determines that the color ink cartridge has been mounted on a carriage and sets a corresponding flag to indicate that a mounted ink cartridge is a color ink cartridge at step 210. The displaying unit 110 then displays a message indicating that a mounted ink cartridge is a color ink cartridge at step 212. If, on the other hand, the detection voltage level $V_D$ is lower than the second reference voltage level $V_{TH2}$, microcomputer 106 determines that the mono ink cartridge has been mounted on a carriage and sets a corresponding flag to indicate that a mounted ink cartridge is a mono ink cartridge at step 214. After the flag is set at step 214, the displaying unit 110 then displays a message indicating that a mounted ink cartridge is a mono ink cartridge at step 216. Accordingly, it is possible to drive the nozzle in order to determine the type of ink cartridge mounted on a carriage of an ink jet recording apparatus.

As described above, the present invention advantageously provides a means to efficiently detect not only whether or not an ink cartridge has been mounted on a carriage of an ink jet recording apparatus without using additional detection pins in the ink cartridge, but also to determine the type of ink cartridge mounted on a carriage; that is whether a mounted ink cartridge is one of a color ink cartridge and a mono ink cartridge.

While there have been illustrated and described what are considered to be preferred embodiments of the present invention, it will be understood by those skilled in the art that various changes and modifications may be made, and equivalents may be substituted for elements thereof without departing from the true scope of the present invention. For example, even if a preferred embodiment contemplates the detection of the specific type of ink cartridge mounted on a carriage of an ink jet recording apparatus, it is within the scope of the present invention simply to detect whether an ink cartridge has been mounted or not. If this is the case, it is not necessary to drive at once all the heating elements. That is, only any one of the heating elements may be driven or a plurality of heating elements may be driven in order to detect whether or not the voltage level is more easily dropped under enhancement of the level to be detected. Moreover, it is possible to detect the type of ink cartridge mounted on a carriage of an ink jet recording apparatus without detecting whether the ink cartridge has been mounted or not. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An ink cartridge detecting circuit in an ink jet recording apparatus, comprising:

a driver operating corresponding nozzles of a printhead installed on an ink cartridge mountable on a carriage by applying a driving power supply voltage to corresponding heating elements installed in said ink cartridge for heating and discharging ink through the corresponding nozzles to print images on a recording medium;

a voltage detector connected to the heating element and detecting a voltage level of said driving power supply voltage dropped by the driving of said heating elements; and a controller driving at least one of said heating elements through said driver, determining whether said ink cartridge has been mounted on said carriage, and after said ink cartridge has been mounted on said carriage, automatically determining whether said ink cartridge mounted on said carriage corresponds to one of a color ink cartridge containing a plurality of different color types of ink and a mono ink cartridge containing a single color type of ink by comparing said voltage level with a plurality of reference voltages.

2. The ink cartridge detecting circuit of claim 1, further comprised of said voltage level detected by said voltage detector decreasing in proportion to the number of heating elements driven by said controller.

3. The ink cartridge detecting circuit of claim 2, further comprised of said controller determining that said ink cartridge has not been mounted on said carriage, when said voltage level is higher than a first reference voltage.

4. The ink cartridge detecting circuit of claim 3, further comprised of said controller determining that said ink cartridge has not been mounted on said carriage, when said voltage level is higher than said first reference voltage.

5. The ink cartridge detecting circuit of claim 4, further comprising a display unit providing a visual display of a message indicating that there is no ink cartridge mounted on said carriage, when said voltage level is higher than said first reference voltage.

6. The ink cartridge detecting circuit of claim 4, further comprised of said controller determining that said ink cartridge mounted on said carriage is a color ink cartridge, when said voltage level is lower than said first reference voltage but is higher than a second reference voltage.

7. The ink cartridge detecting circuit of claim 6, further comprising a display unit for providing a visual display of a message indicating that said ink cartridge mounted on said carriage is said color ink cartridge.

8. The ink cartridge detecting circuit of claim 4, further comprised of said controller determining that said ink cartridge mounted on said carriage is said mono ink cartridge, when said detection voltage level is lower than said first reference voltage and lower than a second reference voltage.

9. The ink cartridge detecting circuit of claim 8, further comprising a display unit for providing a variable visual display of a message indicating that said ink cartridge is said mono ink cartridge.

10. The ink cartridge detecting circuit of claim 1, further comprised of said controller beginning to detect whether said ink cartridge has been mounted on said carriage whenever said ink jet recording apparatus is initialized.

11. An ink cartridge detecting circuit in an ink jet recording apparatus, comprising:

a driver comprising a first resistance element connected between a first voltage terminal providing a driving power supply voltage and a coupling node electrically connected to a plurality heating elements installed in an ink cartridge having an array of nozzles formed on a printhead and mountable on a carriage, and a plurality of switching elements respectively connected to corresponding heating elements of said ink cartridge while heating and discharging ink through corresponding nozzles to print images on a recording medium, when said ink cartridge is mounted on said carriage and a second voltage terminal;

a voltage detector evaluating a detection voltage dropped from the first voltage terminal when said ink cartridge is mounted on said carriage, said voltage detector comprising a second resistance element and a diode connected in series to said coupling node, and a third resistance element connected between said first voltage terminal and said second resistance element;

a converter connected to said voltage detector while converting the detection voltage into digital data having a value corresponding to said detection voltage;

a controller operatively connected to said converter and said driver, driving said heating elements by turning on at least one of said switching elements and for comparing said digital data having a value corresponding to said detection voltage with reference voltage data to determine whether said ink cartridge has been mounted on said carriage.

12. The ink cartridge detecting circuit of claim 11, further comprised of said digital data output from said converter having a value decreasing lower in proportion to the number of heating elements driven by said controller.

13. The ink cartridge detecting circuit of claim 12, further comprised of said controller determining that said ink cartridge has not been mounted on said carriage, when said digital data output from said converter exhibits a value greater than first reference voltage data.

14. The ink cartridge detecting circuit of claim 13, further comprised of said controller determining that said ink cartridge has been mounted on said carriage, when said digital data output from said converter exhibits a value less than said first reference voltage data.

15. The ink cartridge detecting circuit of claim 14, further comprising a display unit for providing a visual display of a message indicating that there is no ink cartridge, when said ink cartridge has not been mounted on said carriage.

16. The ink cartridge detecting circuit of claim 14, further comprised of said controller determining that said ink cartridge mounted on said carriage corresponds to said color ink cartridge when said digital data output from said converter exhibits a value less than said first reference voltage data but greater than second reference voltage data.

17. The ink cartridge detecting circuit of claim 16, further comprising a display unit for providing a visual display of a message indicating that said ink cartridge mounted on said carriage is a color ink cartridge.

18. The ink cartridge detecting circuit of claim 14, further comprised of said controller determining that said ink cartridge mounted on said carriage corresponds to said mono ink cartridge when said digital data exhibits a value less than said first reference voltage data and less than second reference voltage data.

19. The ink cartridge detecting circuit of claim 18, further comprising a display unit for providing a visual display of a message indicating that said ink cartridge mounted on said carriage is a mono ink cartridge.

20. The ink cartridge detecting circuit of claim 11, further comprised of said controller beginning to detect whether said ink cartridge has been mounted on said carriage whenever said ink jet recording apparatus is initialized.

21. An ink cartridge detecting method for an ink jet recording apparatus using a detachable ink cartridge mountable on a carriage and having an array of nozzles formed on the top of a printhead and a plurality of heating elements for heating and discharging ink through corresponding nozzles to print characters and images on a recording medium, and a voltage detection device connected between said heating elements and a driving power supply voltage terminal for detecting a voltage level dropped from the driving power supply voltage by driving of said heating elements, said cartridge detecting method comprising the steps of:

driving at least one of said heating elements of corresponding nozzles of the printhead whenever said ink jet recording apparatus is initialized;

comparing the voltage level to be detected by the voltage detection device according to driving of the corresponding nozzles with a first reference voltage level;

when said voltage level is higher than said first reference voltage level, determining that said ink cartridge has not been mounted on said carriage;

when said voltage level is lower than said first reference voltage level, determining that said ink cartridge has been mounted on said carriage;

after said ink cartridge has been mounted on said carriage, determining that said ink cartridge mounted on said carriage is a color ink cartridge containing a plurality of different color types of ink, when said voltage level is higher than a second reference voltage level; and alternatively, determining that said ink cartridge mounted on said carriage is a mono ink cartridge containing a single color type of ink, when said voltage level is lower than said second reference voltage level.

22. An ink cartridge detecting method for an ink jet recording apparatus comprising the steps of:

simultaneously driving all heating elements installed respectively in nozzles of a recording head formed on an ink cartridge mountable on a carriage for heating and discharging ink through corresponding nozzles to print images on a recording medium, whenever said ink jet recording apparatus is initialized;

detecting a voltage level dropped from a driving power supply voltage by driving the heating elements;

comparing said voltage level with a first reference voltage level;

when said voltage level is higher than said first reference voltage level, determining that said ink cartridge has not been mounted on said carriage and enabling a visual display of a message indicating that there is no ink cartridge;

when said voltage level is lower than said first reference voltage level, comparing said voltage level with a second reference voltage level set to be lower than said first reference voltage level;

when said voltage level is higher than said second reference voltage level, determining that said ink cartridge mounted on said carriage is a color ink cartridge containing a plurality of different color types of ink; and alternatively, when said voltage level is lower than said second reference voltage level, determining that said ink cartridge mounted on said carriage is a mono ink cartridge containing a single color type of ink.

* * * * *